United States Patent [19]

Sorenson

[11] Patent Number: 4,524,253

[45] Date of Patent: Jun. 18, 1985

[54] THREE POSITION SWITCH CONSTRUCTION

[75] Inventor: Richard W. Sorenson, Avon, Conn.

[73] Assignee: Carlingswitch, Inc., West Hartford, Conn.

[21] Appl. No.: 596,170

[22] Filed: Apr. 2, 1984

Related U.S. Application Data

[63] Continuation-in-part of Ser. No. 560,207, Dec. 12, 1983, abandoned.

[51] Int. Cl.[3] ..... H01H 5/06; H01H 21/42

[52] U.S. Cl. ..... 200/68.2; 200/6 BA

[58] Field of Search ..... 200/68.2; 153 K, 6 BA

[56] References Cited

U.S. PATENT DOCUMENTS

| | | | |
|---|---|---|---|
| 2,478,564 | 8/1949 | Bordelon | 200/68.2 |
| 2,782,279 | 2/1957 | Heusser | 200/6 BA |
| 3,329,784 | 7/1967 | Rogero | 200/68.2 |
| 3,403,236 | 9/1968 | Zoludow | 200/68.2 |
| 4,121,071 | 10/1978 | Campbell et al. | 200/68.2 |
| 4,259,552 | 3/1981 | Swann | 200/68.2 |

*Primary Examiner*—John W. Shepperd

*Attorney, Agent, or Firm*—McCormick, Paulding & Huber

[57] ABSTRACT

A "center-off" rocker/actuator switch has cooperating contact lever and actuator pin surfaces that obviate the need for a yoke on the center fixed contact to support the contact lever in its center position. The pin has an enlarged head at its inner end to engage the lever at one or two spaced locations to so support the lever in its center position. A momentary "on" versions has steeply inclined regions of the contact lever on at least one side of the center pivot area thereof, and two progressive "on" versions are disclosed, one with upturned marginal edge portions on the contact lever that cooperate with the pins unique head configuration to permit holding the contact lever "on" in the neutral or "center-off" position for the actuator. The second progressive "on" switch has two "center-off" type contact levers and uniquely shaped pins designed to hold these contact levers in oppositely oriented limit positions when the actuator is centered.

23 Claims, 14 Drawing Figures

THREE POSITION SWITCH CONSTRUCTION

CROSS REFERENCE TO RELATED APPLICATIONS

This application is a continuation-in-part of application Ser. No. 560,207 filed Dec. 12, 1983 and since abandoned by Applicant in favor of this application.

BACKGROUND OF THE INVENTION

This invention relates genrally to electrical switches of the type having a base of insulating material, and with several fixed electrical contacts provided in the form of terminal strips that are mounted in slots in the lower wall of the base. More particularly, a center fixed contact is provided in the form of such a terminal strip without any yoke or the like so that the necessity for staking two metal parts together in order to form a central contact capable of providing a "center-off" position for the movable contact is obviated in the switch of the present design.

The movable contact element or lever is also formed from a generally flat strip of metal, but preferably includes end portions of silver or other precious metal alloy material of the type commonly used in electrical switches of the lever type, wherein the contact lever is adapted to pivot only, and does not slide within the switch case or base.

In one of several versions this movable contact has ramp surface defining portions on either side of a central recess which are adapted to clear the depending pin of the actuator in the switch center position. In another version this pin of the off-center actuator is designed to hold the movable contact in one of its two limit positions when the actuator is centered.

SUMMARY OF THE INVENTION

A pivoted rocker type actuator is mounted in the switch case for manual movement from and to limit positions where one or the other of the end portions of the contact lever is adapted to engage the upper end of a fixed contact terminal conventionally provided within the bottom wall of the switch case. The rocker actuator is provided with a downwardly open radially extending cavity in which a spring acts to urge novel pin means downwardly against the movable contact lever. The lower end of the pin means cooperates with the central region of the movable contact lever intermediate its opposed end portions to define a center position for the rocker, and in at least some versions of the switch to provide a "center-off" position for the movable contact lever. Other versions have selected center-on conditions.

The general object of the present invention then is to provide a "yoke-less" "center-off" lever type electrical switch wherein the actuator has a central position which is stable, and wherein the center position does not require the use of a yoke on the upper or inner end of the center fixed contact of the switch.

In the "center-off" version of electrical switch disclosed herein the spring biased pin means in the rocker has lands spaced on either side of a central or medial protuberance so that these lands contact spaced regions of the contact lever to define this "center-off" position.

In other versions the actuator pin has an offset ramp surface portion designed to keep the movable contact in one of its two limit positions depending upon the direction of the offset.

The unique configuration for the pin means with its medial protuberance and lands spaced therefrom on one or both sides provides a unique "center-off" switch or a momentary "center-off" switch simply by installing either one of two slightly different configurations for the movable contact lever or pin. In the momentary "center-off" switch the contact lever is provided with a stable "center-off" position, but rather than providing stable "on" positions to either side of this center position the momentary switch utilizes the spring biasing force exerted on the pin means to cause the lever and the rocker to tend to return to their respective center positions. The contact lever has at least one relatively steep ramp surface such that the medial protuberance of the pin means will tend to slide down this ramp surface to return to its central position and hence to return the contact lever to its central position as well.

In a third version of the invention the contact lever has at least one upwardly projecting tab portion which selectively engages at least one of the lands on the pin means to hold the contact lever in one of its two "on" conditions not only when the rocker actuator is in one of its limit positions, but also when the lever is in its center position. This configuration is especially useful in a progressive "on" type switch having two subcavities within the switch case, and having the capability for moving at least one of the contact levers in this manner.

In a fourth version of the invention the "center-off" movable contact lever can be held in one of the other limit positions for such lever as a result of an offset ramp surface provided on the pin means of the actuator or rocker. This version is functionally similar to the third version referred to in the preceding paragraph.

DETAILED DESCRIPTION

Figure 3:
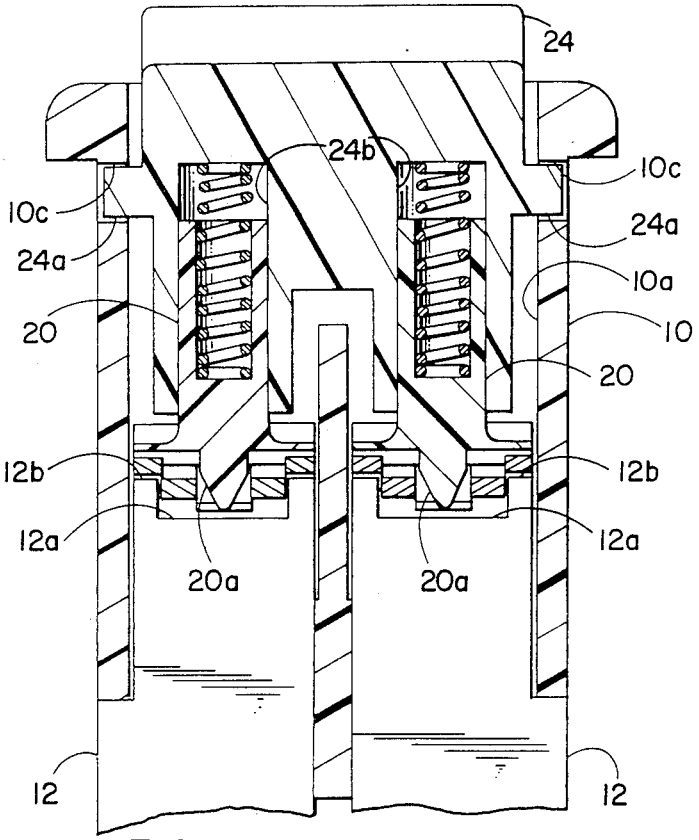
FIG. 3 is a sectional view taken generally on the line 3—3 of FIG. 1.
Figure 4:
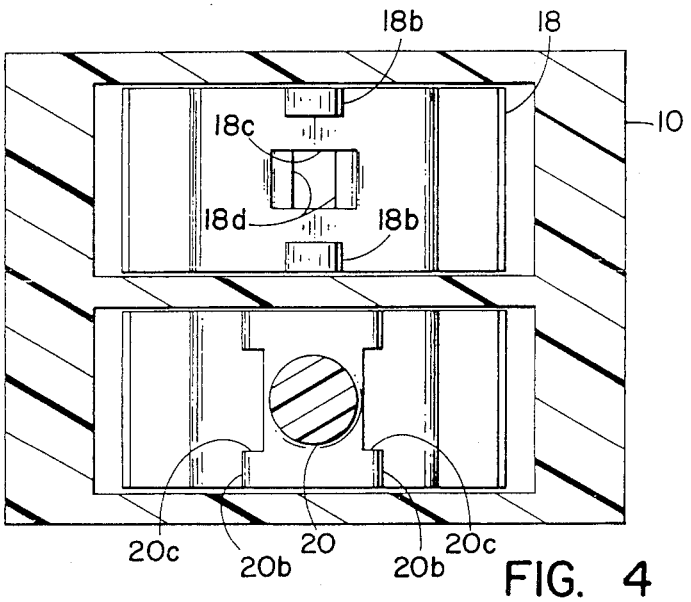
FIG. 4 is a horizontal sectional view taken generally on line 4—4 of FIG. 1 but illustrating the plan view of the contact lever in one subcavity within the switch case by eliminating or omitting the pin means provided within the rocker/actuator in that subcavity of the switch case.
Figure 5:
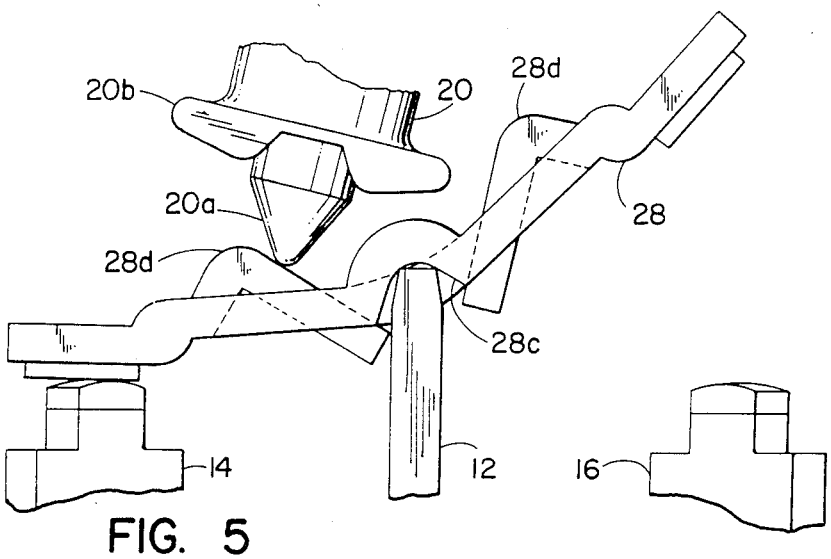
FIG. 5 is a schematic view illustrating an alternative embodiment of the present invention wherein the movable contact lever is configured to act as a three position "center-off" switch of the momentary type.
Figure 6:
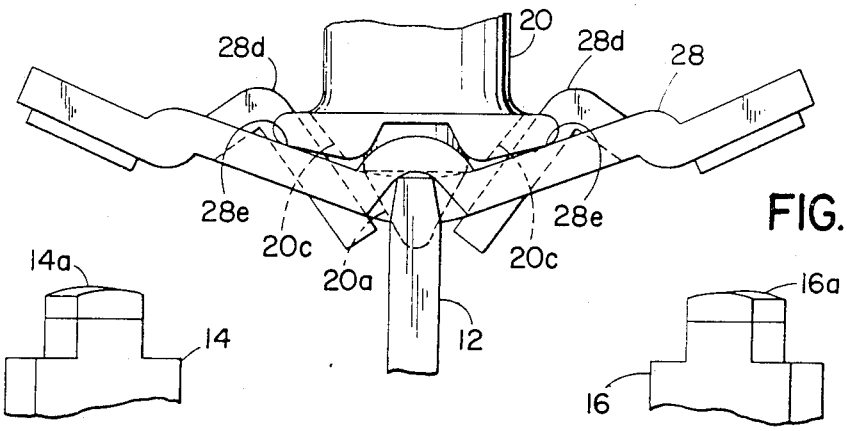
FIG. 6 illustrates the configuration for the movable contact lever when the switch of FIG. 5 is in its "center-off" position.

Turning now to the drawings in greater detail, FIGS. 1–4 inclusively show a "yoke-less" "center-off" switch construction to be described. FIGS. 5 and 6 show an alternative embodiment wherein the "center-off" switch of FIGS. 1–4 is equipped with a movable contact lever of slightly different configuration capable of momentary "on" positions for both the rocker/actuator and the movable contact lever. FIGS. 7–10 illustrate a second alternative embodiment for the switch of FIGS. 1–4 wherein the movable contact lever does not have a "center-off" position, but instead is capable of a center position such that the contact lever remains in one of its two "on" conditions even when the rocker/actuator has been moved to and is securely held in its center position. This latter switch is especially useful in a progressive "on" type switch because it avoids the necessity for a somewhat more complicated fixed contact configuration as shown for example in issued U.S. Pat. No. 4,347,411 issued Aug. 31, 1982 and the assigned to assignee herein entitled "Progressive Switch".

DETAILED DESCRIPTION OF FIGS. 1–4

The above mentioned copending application Ser. No. 309,458 entitled "Electric Swith With Nested Terminals" since issued as U.S. Pat. No. 4,440,991 and assigned to the assignee herein is referred to for purposes of a detailed description of the case or base 10 illustrated in FIGS. 1–4 herein. This copending application describes in detail the configuration for the plastic switch case 10 and its associated integrally formed components such as the wings (not shown here) that serve to support the switch case in a panel opening (not shown). The switch case 10 defines an upwardly open cavity 10*a* defined by integral side and end walls and a bottom wall 10*b*. Several fixed contacts in the form of conductive strips of flat metal are provided in spaced relationship along this bottom wall 10*b* and as shown these terminals include a center fixed contact 12 associated with each of two side-by-side cavities as best shown in FIGS. 3 and 4.

The other of said fixed contacts may be inclined with respect to the longitudinal axis of each of these subcavities as taught in my copending application, and it is noted that this angled configuration for the said other fixed contacts 14 and 16 does not form an essential part of the present invention, and that this configuration is adopted chiefly to reduce the space necessary for utilizing flat strip type terminals to define the fixed contact points within the electrical switch itself.

Figure 1:
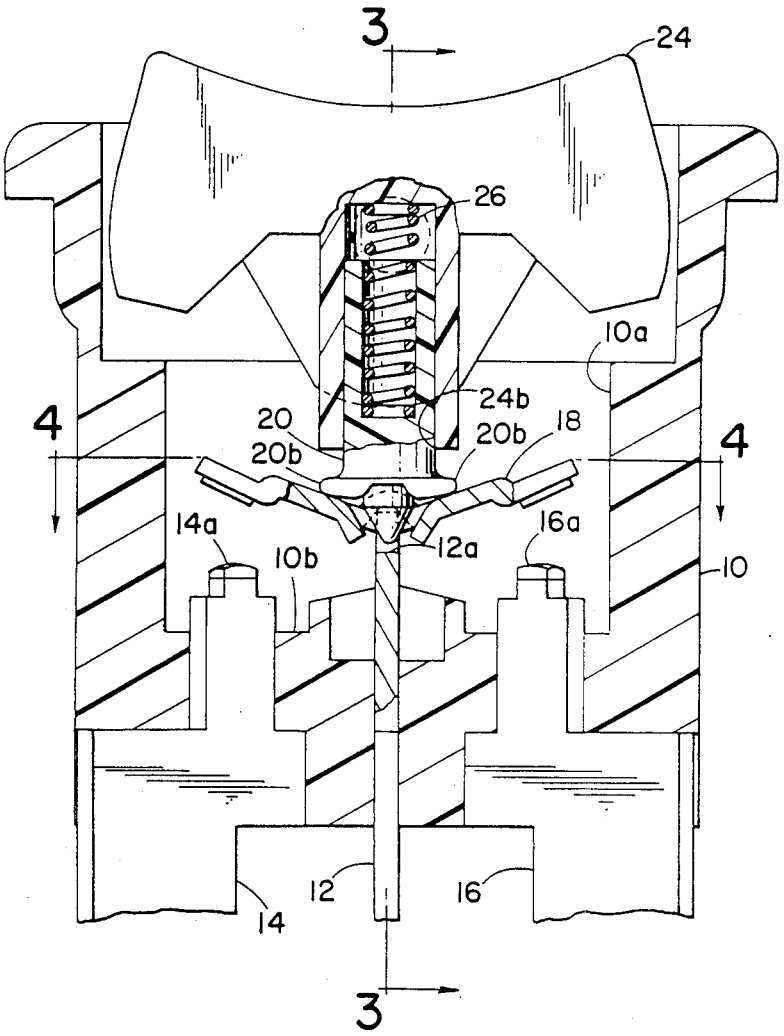
FIG. 1 is a vertical sectional view through a switch constructed in accordance with the present invention and illustrates the rocker/actuator in its "center-off" position. The opposed fixed contacts are shown in full lines in order to illustrate their angled configuration in full. The reader is referred to copending patent application Ser. No. 309,458 filed Oct. 7, 1981 and entitled "Electric Switch With Nested Terminals", assigned to the assignee herein, and now issued as U.S. Pat. No. 4,440,991. The disclosure therein is incorporated by reference herein, particularly with respect to the contact terminals. The yoke arrangement at the inner or upper end of the center terminal, for supporting the movable contact lever in a "center-off" position represents the conventional configuration for a "center-off" lever type electrical switch.
Figure 2:
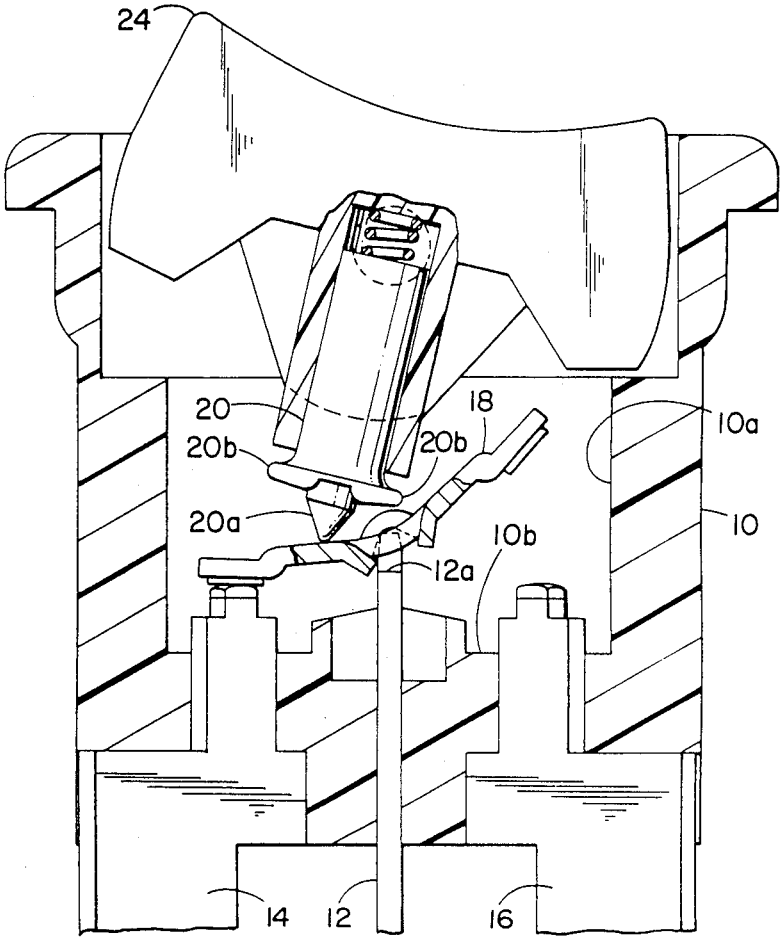
FIG. 2 is a sectional view similar to FIG. 1 but illustrating the rocker and movable contact lever in their respective limit positions, such elements each being capable of an opposed limit position which would be a mirror image of that shown in FIG. 2.

As shown in FIGS. 1 and 2 the upper end of center fixed contact 12 is preferably spaced slightly above the upper end of the other fixed contacts 14 and 16 so as to support a movable contact lever 18 in a "center-off" position (FIG. 1) wherein the opposed free end portions of the contact element or lever 18 are spaced from the inner or upper ends 14*a* and 16*a* of the other fixed contacts 14 and 16 respectively. More particularly, the upper end of center fixed contact 12 is recessed as best shown at 12*a* in FIG. 3 to provide clearance for the lower end of pin means 20 associated with the rocker-/actuator 24 to be described. Movable contact lever 18 is pivotably supported on fulcrum defining means 12*b*, 12*b* associated with each of two center fixed contacts 12 and 12 in FIG. 3. The movable contact lever 18 has cooperating downwardly open recesses 18*b*, 18*b* provided in its marginal side edges at the midportion of the lever 18 for cooperating with the fulcrum defining means 12*b*, 12*b* of the fixed center contact 12 for this purpose. FIG. 4 illustrates the movable contact lever 18 and also shows that a center opening 18*c* is provided in the movable contact lever 18 to provide clearance for the lower end 20*a* of pin means 20 to be described.

The rocker/actuator 24 is of conventional configuration, and includes laterally projecting support means 24*a*, 24*a* in the form of integrally formed pins which are pivotably received in actuator support regions of the case 10. The latter preferably comprises laterally aligned openings 10*c*, 10*c* defined in the side walls of the switch case 10. In the double pole switch configuration illustrated in FIGS. 3 and 4 the actuator 24 also includes downwardly open cylindrical recesses 24*b*, 24*b*, each of these recesses has pin means 20, 20 slidably received therein for radial movement toward and away from the pivot axis of the rocker 24. Springs 26, 26 are provided in these actuator recesses to urge the pin means 20, 20 downwardly relative to the actuator pivot axis. Thus, rocker/actuator 24 is conventionally constructed in that it houses side-by-side pin means to achieve simultaneous operation of two side-by-side contact levers 18, 18 in two side-by-side subcavities defined within the switch case 10.

In accordance with the present invention the lower end of pin means 20 cooperates with the central region of movable contact lever 18 to achieve a "center-off" position for the lever 18, which "center-off" position is a stable one, achieved without the necessity for a yoke at the upper end of fixed center contact 12, such as shown for example in my copending application Ser. No. 309,458.

More particularly, the individual pin means 20, 20 each includes a centrally located medial protuberance 20*a* best shown in FIG. 2 for controlling the movement of contact lever 18 when the rocker/actuator 24 has been moved out of the "center-off" position illustrated in FIG. 1 to be moved toward one of the two opposed limit positions, such as that shown in FIG. 2.

The lower end of pin means 20 also defines a generally rectangular enlarged portion or head 20*b*, which enlarged head portion is of generally rectangular configuration as best shown in FIG. 4 to prevent rotation of the pin means 20 in the cylindrical downwardly open cavity 24*b* provided for it in the rocker/actuator 24. The enlarged lower end portion 20*b* of the pin means 20 defines lands, spaced longitudinally relative to the longitudinal axis of the contact lever 18, on both sides of the medial protuberance 20*a* in order to provide support for the movable contact lever 18 in the "center-off" position for the lever 18 and actuator 24 as shown in FIG. 1. These spaced lands of the head portion 20*b* engage spaced regions of the movable contact lever 18 and serve to urge the lever downwardly in this "center-off" position with a force or forces such that the contact lever 18 is held in the "off" position shown.

Thus, the enlarged lower end or head portion of the pin means 20 serves two functions, one to prevent rotation of the pin means within the cavity 24*b*, and the second to provide support for the contact lever 18 on the upper fulcrum points 12*b* defined at the upper end of the flat center fixed contact 12. The spaced lands defined by the lower end portion 20*b* of the pin means 20 simultaneously engage these spaced regions of the contact lever 18 to provide support therefor in this "center-off" position.

The centrally located medial protuberance 20*a* of the pin means 20 is not in contact with the lever 18 in this "center-off" position for the contact lever 18. The above mentioned central clearance opening 18*c* in the contact lever 18 provides such clearance for this medial portion 20*a* and it is noted that lower tip end portion of the protuberance 20*a* extends well below these lands defined by the enlarged head portion 20*b* of the pins means 20. Still with reference to this central clearance opening 18*c* it will be apparent from the various views that the said spaced regions of the contact lever define a longitudinally extending valley therebetween, which valley has inclined ramp surfaces 18*d* defined on either side of the central clearance opening 18*c*. Opening 18*c* is itself defined in the bottom of this valley. These ramp surfaces 18*d*, 18*d* are adapted to be engaged by the tip portion of the medial protuberance 20*a* as the actuator moves out of its "center-off" position toward one of the two opposed "on" positions as illustrated in FIG. 2. More particularly, these ramp surfaces 18*d* can be seen from a comparison of FIGS. 1 and 2 to be generally convex in configuration with at least a portion thereof being laterally coextensive with the spaced regions engaged by the downwardly facing lands of the enlarged head 20*b* for the pin means 20. As a result of this convex contour medial portion 20*a* will tend to hold movable contact lever 18 in the "on" position shown in FIG. 2 and in an opposed mirror image position (not shown) when the actuator 24 is oppositely arranged. This is a result of the spring biasing force exerted downwardly on the pin means 20 by spring 26, and is also attributable to the fact that the line of action for this spring 26 and of the pin means 20 being exerted at an angle greater than 90 degrees with respect to the regions of the contact lever 18 that engage protuberance 20*a* in these opposed limit positions for the switch.

DETAILED DESCRIPTION OF FIGS. 5 AND 6

Turning next to the alternative embodiment of the present invention as illustrated in FIGS. 5 and 6, it is noted that the switch case and rocker/actuator of FIGS. 1–4 are identical to the version shown in FIGS. 5 and 6, and that the pin means 20 may be identical to the pin means 20 shown in FIGS. 1–4. Movable contact lever 28 in FIG. 5 does differ from that shown at 18 in FIGS. 1–4 particularly in the area spaced on either side of the central opening 28*c* of lever 28 (corresponding to the opening 18*c* in the lever 18 of FIG. 4). More particularly, inclined ramp sufaces 28*d*, 28*d* are provided at an angle to the line of action for the pin means 20 such that the spring 26 which urges the pins means 20 downwardly causes the lower end of medial protuberance 20*a* to tend to slide downwardly on ramp surface 28*d* until the rocker/actuator and contact lever 28 assume the "center-off" position of FIG. 6.

From FIG. 6 it will be apparent that the medial protuberance 20*a* remains clear of the contact lever 28 in the "center-off" position, and that the spaced lands 20*b* on the enlarged head portion of the pin means 20 serve to engage spaced regions of the movable lever 28 in order to support lever 28 in the "center-off" position shown. More particularly, these spaced regions of the contact lever 28 comprise laterally two laterally spaced separated abutment areas 28*e*, 28*e* provided on either side of the path of movement for the medial protuberance 20*a*, and on either side of the ramp surface defining portions 28*d*, 28*d*.

As so constructed and arranged the medial protuberance 20*a* does not engage contact lever 28 in the "center-off" position, but is adapted to move on a longitudinally extending center line of the contact lever 28 in the elongated generally rectangularly shaped subcavity or space defined in the switch case cavity to engage convex ramp surfaces 28*d*, 28*d*. Although the switch of FIGS. 5 and 6 comprises a "center-off" switch capable of momentary closing as a result of moving rocker/actuator in either direction out of said center position, it will be apparent that one could provide a "center-off" switch with momentary closing capability in one direction only, and with normal closing operation in the opposite direction. The contact lever in such a switch (not shown) would have one steeply inclined ramp surface, such as described above with reference to 28*d* and on the opposite side of the valley defined between it and the other side of the lever one would provide a convex ramp surface, such as shown and described with reference to 18*d* in FIGS. 1–4. In order to provide a common pin means 20 for both the switch of FIGS. 1–4 and that shown in FIGS. 5 and 6 a slot 20*c* is preferably provided in the head portion 20*b* of the pins means 20 to provide clearance between the contact lever 28 and the pin means 20 when the lever 28 is in the "center-off" position shown in FIG. 6.

DETAILED DESCRIPTION OF FIGS. 7, 8, 9 AND 10

Figure 7:
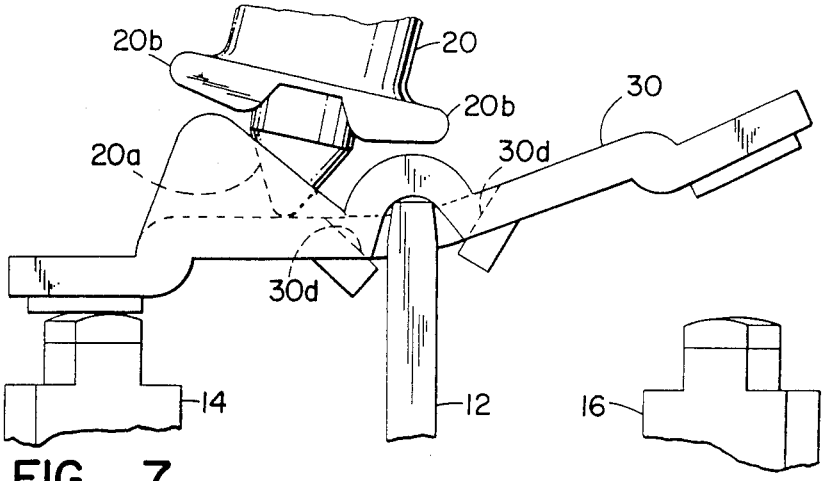
FIG. 7 is a schematic view of a three position switch wherein the movable contact lever has a second alternative configuration such that the rocker/actuator serves to hold the movable contact in one of its two "on" conditions when the rocker/actuator is in its center position.
Figure 8:
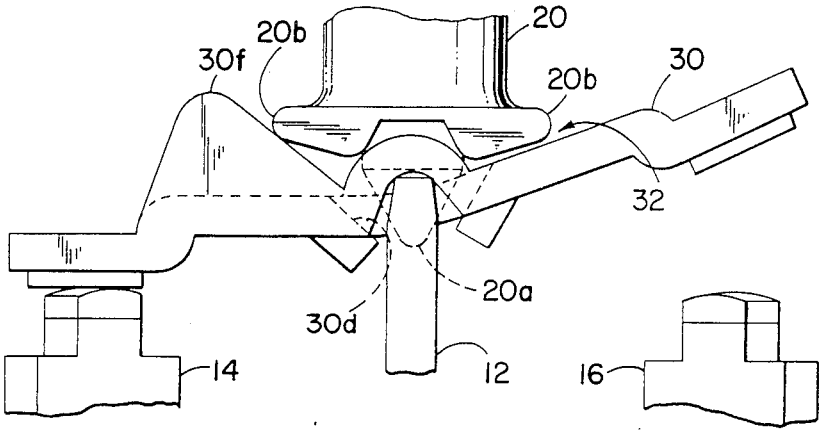
FIG. 8 shows the switch of FIG. 7 with the rocker-/actuator in its center position.

Turning next to the embodiment illustrated in FIGS. 7–10 inclusively, it will be noted that the switch case and rocker actuator shown and described with reference to the previous two embodiments are identical to those required to accommodate the contact lever 30 illustrated in FIGS. 7–10. More particularly, the pin means 20 in FIG. 7 is identical to that shown and described with reference to FIGS. 1–6 inclusively. Depending medial protuberance 20*a* is adapted to engage spaced regions of the movable contact lever 30 so as to define the switch "on" condition at both extremities of movement for the rocker/actuator as best shown in FIGS. 7 and 9.

Figure 9:
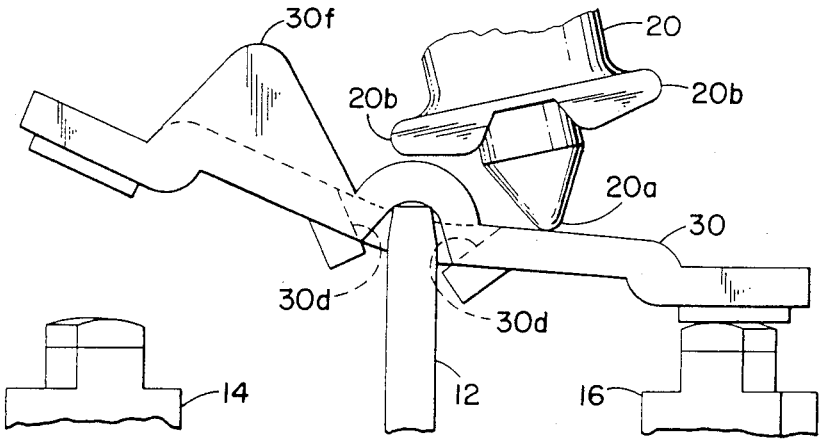
FIG. 9 illustrates the switch of FIGS. 7 and 8 with the movable contact lever in the other of its two "on" positions, that is opposite to the "on" position illustrated in FIG. 7.

With particular reference to FIG. 9 it will be apparent that convex ramp surface 30*d* serves to achieve this motion for the contact lever 30 in direct response to pivoting movement of the rocker/actuator and its associated pin means 20.

Figure 10:
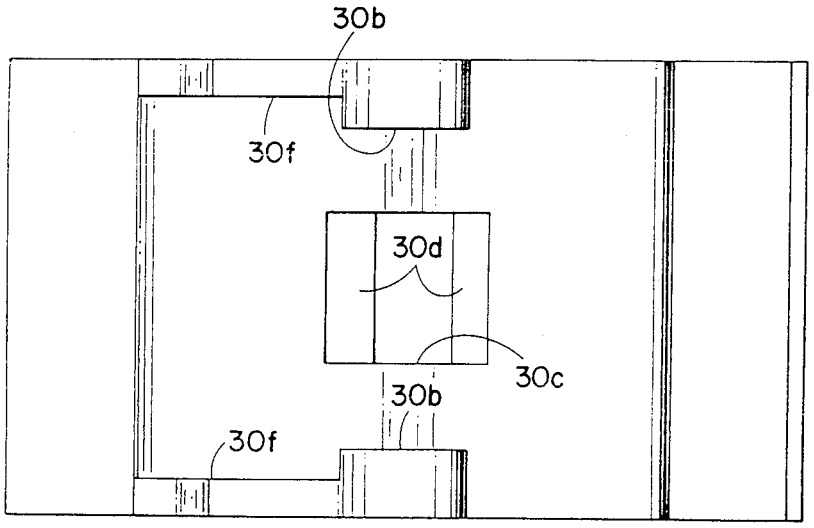
FIG. 10 is a plan view of the movable contact lever shown in the switch embodiment of FIGS. 7, 8 and 9.

The enlarged head lower end portion 20*b* of pin means 20 is identical in geometry to that described previously, but the configuration for contact lever 30 is such that in the center position for rocker/actuator and its associated pin means 20 (FIG. 8) contact lever 30 is not held in a "center-off" position, but rather is held in one of its two "on" limit positions as a result of engagement between one of the lands defined by the enlarged head portion 20*b* and a marginal edge portion 30*f* of lever 30. Actually there are two such upturned marginal edge portions 30*f*, as best shown in FIG. 10 which portions are spaced laterally on either side of the convexly contoured ramp portion 30*d*. The steeply inclined ramp surface 30*f* defined by each such marginal edge portions is steep enough so that the opposite land defined by head portion 20*b* of pin means 20 does not contact lever 30 as shown by the space provided between it and the lever 30 as suggested at FIG. 32 in FIG. 8.

As so constructed and arranged the switch of FIGS. 7–10 provides for opposed "on" positions for the rocker/actuator and its associated movable contact lever 30 as shown in FIGS. 7 and 9. However, in the center position for rocker/actuator, as suggested in FIG. 8 by the vertically oriented position for the pins means 20, contact lever 30 is held in one of its two limit "on" positions. Thus, and by way of example, it would be possible to provide a double pole switch of the type shown in FIG. 3 wherein one subcavity is provided with a contact lever of the type shown at 30 in FIGS. 7–9, and by providing a different type of contact lever such as that described above with reference to 18 or 28 in the previously described embodiments. Such a configuration would provide an ideal progessive "on" switch having three positions such that successive voltage levels could be applied to a circuit associated with the several contacts of such a double pole switch. It is in such a switch that the contact lever 30 of FIGS. 7–10 would be especially useful. Details of the makeup of such a switch are shown and described in issued U.S. Pat. No. 4,347,411 referred to above.

DETAILED DESCRIPTION OF FIGS. 11, 12 AND 13

These views shows a fourth version of double pole switch wherein the case is identical to that shown and described previously and wherein the two contact levers 28 and 28 are identical to those shown in FIGS. 5 and 6.

Figure 11:
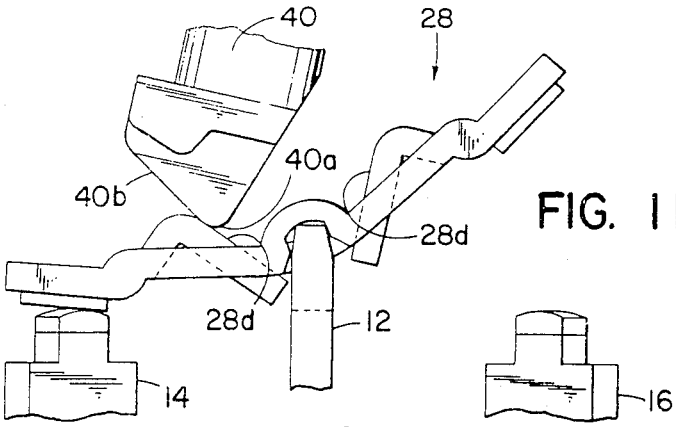
FIG. 11 is a schematic view of a three position switch wherein the movable contact lever is identical to that of FIGS. 5 and 6 but wherein the rocker/actuator has an offset pin ramp surface portion designed to hold this lever in the "on" position.
Figure 12:
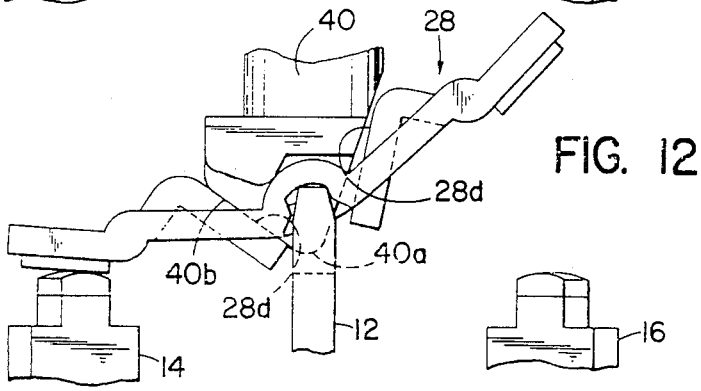
FIG. 12 shows the switch of FIG. 11 with the rocker-/actuator in a center position and the lever held in the same condition as that of FIG. 12.
Figure 13:
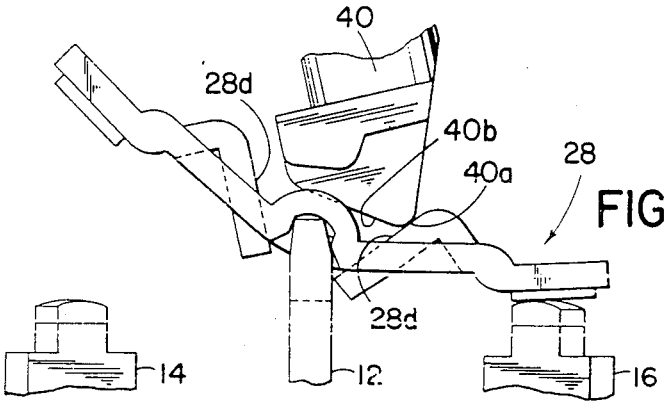
FIG. 13 shows the switch of FIG. 11 with its movable contact held in an opposite limit position.

Only one side of the switch is shown (schematically) in FIGS. 11–13 and the rocker (not shown) has two side-by-side pin means 20, 20 (one shown) both of which are operated by a single rocker (such as that shown at 24 in FIGS. 1–4).

Pin means 40, 40 are provided in downwardly open cylindrical recesses (not shown) of the actuator and only one such pin appears in these schematic views, but it will be apparent that a second similar pin can be provided in said actuator 24 as shown and described with reference to the pins 20, 20 of FIGS. 1–4.

Pin 40 is spring biased downwardly so that the lowermost end or tip 40*a* is adapted to engage the ramp surfaces 28*d*, 28*d* to hold contact lever 28 in the limit positions shown in FIGS. 11 and 13 repectively.

Pin 40 is unlike the pin 20 described previously in that there are no symmetrically arranged lands 20*b*, 20*b* as in the pin 20, but only a single ramp surface 40*b* on one side of medial protuberance 40*a*. FIG. 12 shows how this ramp surface 40*b* serves to engage the ramp surface 28*d* in order to hold contact lever 28 in the same "on" position as occupied by it in FIG. 11. Compare the functional result for lever 30 in FIGS. 7 and 8. Pin 20 requires lever 30 to have upturned marginal edge portions 30*f*, 30*f* engaged by one of two symmetrical lands 20*b*, 20*b* in pin 20 to achieve the same result that asymmetrical ramp 40 achieves in pin 40 of the FIG. 12 switch, and with a more readily fabricated configuration for the contact lever 28. Note that lever 28 is identical to the lever in the switch of FIGS. 5 and 6.

Although FIGS. 11–13 show a single contact lever, such as would be provided in one side or subcavity of the double pole switch case 10 of FIGS. 1–4, it will be apparent that a second contact lever can be operated by another pin means from a single rocker/actuator 24. As mentioned previously pin means 40 has an offset ramp surface 40*b* adapted to hold contact 28 closed (FIG. 12) when rocker/actuator 24 is centered. Pin means 40, like pin means 20, has a cylindrical upper portion slidably received in the downwardly open recess 24*b* of rocker-/actutor and a generally rectangular head portion with sides (see FIG. 3) to prevent rotation of the pin in said recess 24*b*. It will be apparent that pin means 40 can be assembled with rocker/actuator either in the orientation shown in FIGS. 11, 12 and 13 or with ramp surface 40*b* offset oppositely to hold contact lever 28 in an opposite or mirror image position to that shown in FIG. 12.

As described above with reference to FIGS. 7, 8 and 9 a progressive switch can be assembled with two contact levers 30, 30 arranged oppositely in the two side-by-side switch cavities of switch case 10. In the switch of FIGS. 11, 12 and 13 the same result can be achieved by arranging two side-by-side pins 40, 40 oppositely and utilizing the symmetrical contact levers 28, 28.

Although the switch of FIGS. 11–13 has the same contact lever 28 as provided in the switch of FIGS. 5 and 6 it will be apparent that lever 18 as provided in the switch of FIGS. 1–4 might be provided instead of lever 28. This substitution, of lever 18 for lever 28 in the switch of FIGS. 11–13 provides a progressive switch that is not momentary in operation but one that has stable "on" limit positions for the actuator.

In summary, the switch of FIGS. 11, 12 and 13 provides an economically and mechanically efficient momentary progressive switch when the contact lever 28 s utilized. If a stable "on" position is desired, rather than the momentary "on" feature, levers 28, 28 can be replaced by levers 18, 18 in this same switch of FIGS. 11, 12 and 13. In order to provide "center-off" switches of the stable or the momentary variety one can simply provide pins 20, 20 and levers 18, 18 as in FIGS. 1–4, or pins 20, 20 and levers 28, 28 as suggested in FIGS. 5 and 6. In all of the above described switches the same rocker 24 and switch case 10 can be provided, as is also true with respect to the center blade shaped terminal 12 and the fulcrum defining upper end thereof.

DETAILED DESCRIPTION OF FIG. 14

Figure 14:
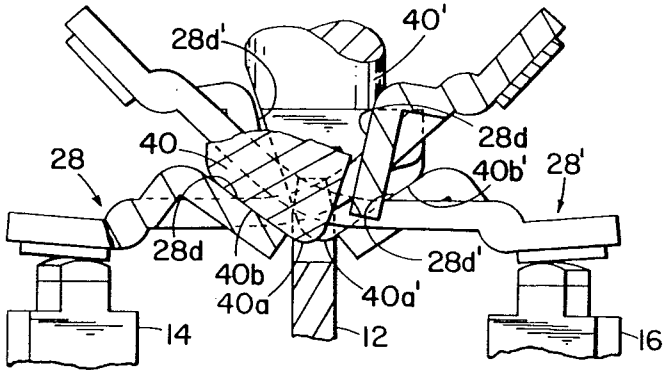
FIG. 14 shows a double pole version of the single pole switch of FIGS. 11, 12 and 13 and illustrates the center position of the two movable contacts with extraneous elements eliminated or broken away to illustrate the nearer of these two contacts in vertical section and the other contact in full and/or broken lines.

This view illustrates a variation of the fourth version illustrated in FIGS. 11, 12 and 13 wherein a double pole switch is provided with a second pin means 40' oriented alongside the pin means 40, and moves with pin means 40 because both are mounted in a common pivotally mounted actuator (not shown) generally similar to that shown in FIGS. 1 and 2. The second pin means 40' is identical to the pin means 40 but is oriented oppositely to that of the first pin 40. This configuration provides a progressive switch configuration such that the two contact levers 40, 40' are progressively switched through the center of intermediate position shown in FIG. 14. The opposed limit positions for this double pole switch are identical to those shown in FIGS. 11, 12 and 13.

I claim:

1. A switch comprising a base of insulating plastic and defining an upwardly open cavity, several fixed contacts spaced along a bottom wall of said cavity, said fixed contacts including a central fixed contact having an upper edge defining a single fulcrum, said switch base having means defining actuator support regions, an actuator including support means cooperating with said support regions to movably support said actuator so that an inner portion moves inside said cavity between opposed limit positions, a movable contact lever having a mid-portion pivotally supported on said fulcrum defining upper edge of said central fixed contact for movement from and to oppositely oriented limit positions such that the opposed free end portions of said movable contact lever are adapted to abut other of said fixed contacts spaced to either side of said one centrally located fixed contact, said central fixed contact consisting of a flat terminal strip mounted in a slot provided in the case bottom wall, said central fixed contact fulcrum defining upper edge portion having a relieved portion, pin means slidably received in said actuator and having a medial protuberance of width significantly less than the width of said lever and movable in a path through a central valley portion of said movable contact and through said relieved portion, spring biasing means acting on said pin means so that said pin means acts on said movable contact lever to urge said lever downwardly at least in limit positions thereof corresponding to said two limit positions of said actuator, said pin means having at least one land for selectively engaging a region of said contact lever located to one side of said central valley portion engaged by said medial protuberance whereby to provide support for said contact lever in at least one position of said contact lever, said at least one land comprising two separated abutment area provided in laterally spaced relationship to said path of movement for said medial protuberance.

2. The switch according to claim 1 wherein a second lane is provided so that two spaced lands of said pin means simultaneously engage spaced regions of said contact lever to provide support therefor in said one position, said one position comprising a center position such that said lever end portions are spaced from said other fixed contacts and only said center fixed contact engages said lever to define a "center-off" position for said switch, said pin defining means having said medial protuberance located between said spaced lands and projecting into a central clearance opening of said valley portion in said contact lever when said lever is in said "center-off" position such that only said spaced lands of said pin means engage said lever to urge said lever downwardly in said one "center-off" position.

3. The switch according to claim 2 wherein said spaced regions of said contact lever so engaged by said spaced lands of said pin means to so define said one "center-off" contact lever position are also adapted to be engaged by said medial protuberance of said pin means in said opposed limit positions of said contact lever.

4. The switch according to claim 2 wherein said spaced regions of said contact lever define a valley therebetween, said valley having inclined ramp surfaces on either side and said central clearance opening defined in the bottom of said valley, said ramp surfaces being adapted to be engaged by said medial protuberance as said actuator moves said contact lever out of said "center-off" position to disengage one of said lands of said pin means from a corresponding spaced region of said contact lever as said actuator moves toward one of said limit positions.

5. The switch according to claim 4 wherein at least one of said valley ramp surfaces forms a convex contour for slidably engaging said medial protuberance during said actuator movement toward a corresponding limit position so that said limit position for said contact lever is stable and does not require that the actuator be held to continue said corresponding limit position.

6. The switch according to claim 5 wherein both valley ramp surfaces form a convex contour for said medial protuberance during such actuator movement to provide stable limit positions for said contact lever in both its opposed limit positions.

7. The switch according to claim 4 wherein at least one of said valley ramp surfaces forms a steep slope for slidably engaging said medial protuberance during said actuator movement to a corresponding limit position so that said limit position for said contact lever is unstable and said biasing means urges toward the actuator said "center-off" position.

8. The switch according to claim 7 wherein both said valley ramp surfaces are formed by slopes steep enough to provide unstable limit positions for said contact lever in both its opposed limit positions.

9. The switch according to claim 1 wherein said actuator is pivotally supported in said switch case, said pin means comprising a pin slidably received in a generally downwardly open cavity defined by said actuator, said spring biasing means for yieldably urging said pin into engagement with said contact lever provided in said cavity, said pin having an enlarged lower end portion defining said spaced lands and also defining a medial protuberance between said spaced lands, said switch case cavity including a generally rectangularly shaped spaced in which said contact lever is located, said lever also having a rectangular planform and pivotably mounted in said space, said pin having said lower end so shaped that the width thereof corresponds closely to the width of said rectangularly shaped contact lever space, and said contact lever having spaced regions adjacent said clearance opening.

10. The switch according to claim 9 wherein said medial protuberance is so located that it moves on the longitudinally extending center line of said contact lever in said rectangular space, said enlarged lower end portion being generally rectangular with laterally opposed surfaces slidably engaging the longitudinally extending sides of said rectangular space within said switch case, said spaced lands defined in longitudinally opposed portions of said enlarged lower end portion.

11. The switch according to claim 10 wherein said movable contact lever has a central clearance opening to provide clearance between said medial protuberance and said lever when said actuator is in a central position between said opposed limit positions.

12. The switch according to claim 11 wherein said spaced regions of said contact lever define a valley therebetween, said valley having inclined ramp surfaces on either side and said central clearance opening defined in the bottom of said valley, said ramp surfaces being adapted to be engaged by said medial protuberance as said actuator moves from said central position toward one or the other of said opposed limit positions.

13. The switch according to claim 12 wherein at least one of said valley ramp surfaces forms a convex contour for slidably engaging said medial protuberance during actuator movement toward a corresponding limit position so that a corresponding limit position for said contact lever is stable and does not require that the actuator be held to continue said corresponding limit position.

14. The switch according to claim 13 wherein said contact lever includes upturned marginal edge portions spaced laterally on either side of said convex contoured ramp portion for said medial protuberance, said upturned marginal edge portions also spaced longitudinally at least slightly from said convex contoured ramp portion and defining one of said contact lever regions adapted to be engaged by one of said spaced lands of said pin means, said one land defined by laterally spaced abutment areas provided in laterally spaced relationship to the path of movement for said medial protuberance of said pin means, said laterally spaced areas so defined by said upturned marginal edge portions providing ramp surfaces to be so engaged by said one lands abutment areas when said actuator is in said center position that said contact lever is held in one of said limit positions.

15. The switch according to claim 14 wherein said contact lever is held in said one limit position by the cooperative action of said medial protuberance and said abutment areas of said one land during movement of said actuator between its one limit position and its center position.

16. The switch according to claim 11 wherein said contact lever includes upturned marginal edge portions spaced laterally on either side of one of said ramp surfaces for said medial protuberance, said upturned marginal edge portions also spaced longitudinally at least slightly from said one ramp surface and serving also to define one of said contact lever regions adapted to be engaged by one of said spaced lands of said pin means, said one land defined by laterally spaced abutment areas provided in laterally spaced relationship to the path of movement for said medial protuberance of said pin means, said laterally spaced areas so defined by said upturned marginal edge portions providing ramp surfaces to be so engaged by said one lands abutment areas when said actuator is in said center position that said contact lever is held in one of said limit positions.

17. The switch according to claim 16 wherein said contact lever is held in said one limit position by the cooperative action of said medial protuberance and said abutment areas of said one land during movement of said actuator between its limit position and its center position.

18. A switching comprising a base of insulating plastic and defining an upwardly open cavity, several fixed contacts spaced along a bottom wall of said cavity, said fixed contact including a central fixed contact defining a fulcrum, said switch base having means defining actuator support regions, an actuator including support means cooperating with said support regions to movably support said actuator so that an inner portion moves inside said cavity between opposed limit positions, a movable contact lever having a mid-portion pivotably supported on said fulcrum and adapted to move from and to oppositely oriented limit positions such that the free end portions of said lever are adapted to abut other of said fixed contacts spaced to either side of said one central fixed contact, said fulcrum defined at the upper edge of said central fixed contact which central contact consists of a flat terminal strip mounted in a slot provided in the case bottom wall, pin means slidably received in said actuator and having a medial protuberance, spring biasing means acting on said pin means and said pin means in turn acting on said movable contact lever to urge the lever downwardly at least in limit positions thereof corresponding to said limit positions of said actuator, said pin means having two spaced lands, which lands are adapted to simultaneously engage spaced regions of said contact lever to provide support therefor in a central position for said lever such that end portions thereof are spaced from said other fixed contacts, said pin defining means having said medial protuberance located between said spaced lands and projecting into a central clearance opening in said contact lever when the lever is in its "center-off" position so that only the spaced lands of said pin means engage the lever to urge it downwardly in its "center-off" position, said contact lever further including a valley between said spaced regions, said valley being more particularly defined by inclined ramp surfaces on either side of said central clearance opening and adapted to be engaged by said medial protuberance as said actuator moves said contact lever out of said "center-off" position whereby to disengage said lands from said spaced regions of said contact lever as the actuator moves toward its limit positions, said valley ramp surfaces formed by slopes steep enough to provide unstable limit positions for the contact lever in the opposed limit positions, and one of said spaced lands so defined by said actuator pin means comprising two separated abutment areas provided in laterally spaced relationship with respect to the path of movement for said medial protuberance, and wherein said clearance opening is provided on the longitudinal center line of said contact lever, and said at least one valley ramp surface is provided between the path of movement for said separated abutment areas that define said one spaced land.

19. A switch comprising a base of insulating plastic and defining an upwardly open cavity, several fixed contacts spaced along a bottom wall of said cavity, said fixed contacts including a central fixed contact defining a fulcrum, said switch base having means defining actuator support regions, an actuator including support means cooperating with said support regions to movably support said actuator so that an inner portion moves inside said cavity between opposed limit positions, a movable contact lever having a mid-portion pivotably supported on said fulcrum for movement from and to oppositely oriented limit positions such that opposed free end portions of said lever abut other of said fixed contacts in spaced relationship to either side of said one central fixed contact, said central fixed contact comprising a flat terminal strip mounted in a slot provided in the case bottom wall and defining said fulcrum at its upper edge, pin means slidably received in said actuator and having a medial protuberance or tip, spring means acting on said pin means so that said pin means in turn acts on said lever to urge the lever downwardly, said pin means having a ramp surface oriented at an angle to the direction of movement of said pin means, and wherein said contact lever has two spaced symmetrically arranged regions one of which engages said pin ramp surface to define a center position for said actuator such that said lever is held in one of its oppositely oriented limit positions.

20. The switch according to claim 19 wherein said pin means is assymetrical with said medial protuberance located generally on an axial center line of said slidably mounted pin means and said ramp surface being offset relative to said axial center line, said pin means defining a second ramp surface opposite said one ramp surface and located closer to said axial center line such that said second ramp suface stays clear of said symmetrically shaped contact lever regions when the lever is in said at least one position.

21. The switch according to claim 20 wherein said spaced symmetrically arranged regions of said contact lever define a valley therebetween so that said valley has inclined ramp surfaces on either side thereof, said ramp surfaces on said contact lever being adapted to be engaged by said medial protuberance as said actuator moves into said one limit position and to said oppositely oriented limit position.

22. The switch according to claim 21 wherein said actuator is pivotally supported in said switch case, said switch case cavity including a generally rectangular shaped space having two side-by-side subcavities for two contact levers, each of said levers supported for pivotal motion on an associated fulcrum as aforesaid, said pin means comprising side-by-side pins slidably received in side-by-side recesses in said actuator, biasing means for yieldably urging said pins into engagement with said contact levers, each pin having and enlarged rectangular lower end portion that defines said ramp surface and that has a width such that the pin is slidably and non-rotatably received in its sub-cavity.

23. The switch according to claim 22 wherein said two pins have their respective ramp oriented oppositely to one another so that one contact lever is held in one of its two limit positions when said actuator is centered and the other of said two pins holds the other of said two levers in an opposite limit position when said actuator is so centered.

* * * * *